United States Patent [19]

Tatebe et al.

[11] 4,404,936

[45] Sep. 20, 1983

[54] BREATHER DEVICE FOR OVERHEAD VALVE ENGINES

[75] Inventors: Yoshikazu Tatebe; Masafumi Egami; Toshimitsu Miyawaki, all of Nagoya, Japan

[73] Assignee: Mitsubishi Jukogyo Kabushiki Kaisha, Japan

[21] Appl. No.: 225,658

[22] Filed: Jan. 16, 1981

[30] Foreign Application Priority Data

Apr. 30, 1980 [JP] Japan ..... 55-58269[U]
May 6, 1980 [JP] Japan ..... 55-60697[U]

[51] Int. Cl.[3] ..... F01M 1/00
[52] U.S. Cl. ..... 123/196 R; 123/90.38
[58] Field of Search ..... 123/41.86, 572, 90.38, 123/574, 196 R

[56] References Cited

U.S. PATENT DOCUMENTS

| | | | |
|---|---|---|---|
| 2,461,206 | 2/1949 | Fouse et al. | 123/574 |
| 3,665,906 | 5/1972 | DePalma | 123/572 |
| 3,673,997 | 7/1972 | Sawada | 123/572 |
| 3,754,538 | 8/1973 | Ephraim, Jr. et al. | 123/574 |
| 3,769,798 | 11/1973 | Whittaker | 123/572 |
| 3,908,617 | 9/1975 | Partridge | 123/572 |

*Primary Examiner*—Charles J. Myhre
*Assistant Examiner*—E. Rollins Cross
*Attorney, Agent, or Firm*—McGlew and Tuttle

[57] ABSTRACT

The present invention relates to a breather device for overhead valve engines characterized by being provided with a breather chamber arranged on the side of a cylinder or crank chamber, a push rod chamber formed on the side of and integrally with said cylinder or crank chamber and a cylinder head and making the periphery of each push rod housed within it a blow-by gas passage connecting the above mentioned crank chamber with a rocker chamber and a blow-by gas discharging passage connecting the above mentioned rocker chamber and breather chamber with each other, whereby the pressure fluctuation within the crank chamber can be utilized to utilize the ventilating action of a one-way breather valve, to thereby lubricate the rocker chamber, to need no oil pump and to reduce the cost and the rigidity of the cylinder including the crank case and of the cylinder head can be elevated.

2 Claims, 8 Drawing Figures

BREATHER DEVICE FOR OVERHEAD VALVE ENGINES

DETAILED DESCRIPTION OF THE INVENTION

The present invention relates to a breather device for overhead valve engines characterized by being provided with a breather chamber arranged on the side of a cylinder or crank chamber, a push rod chamber formed on the side of and integrally with said cylinder or crank chamber and a cylinder head and making the periphery of each push rod housed within it a blow-by gas passage connecting the above mentioned crank case with a rocker chamber and a blow-by gas discharging passage connecting the above mentioned rocker arm chamber with the breather chamber.

The conventional generally used four-cycle engines are mostly side valve engines. Such side valve engine has a defect that the efficiency is low. On the other hand, the overhead valve engine high in the efficiency is equipped particularly with an oil pump to lubricate such valve moving part within the rocker chamber as a rocker arm and therefore has a defect that the price is high.

Usually, in the generally used engine, the carburetor and air cleaner are arranged often in the direction at right angles with the crank shaft as required in mounting a working machine. A breather is often led to the air cleaner.

FIG. 1 is a sectioned view of an essential part of a conventional generally used single cylinder forced air-cooled overhead valve (OHV) engine. In the drawing, an engine E houses such moving members as a piston 4, crank shaft 5, cam shaft 6, valve moving device V driven by the cam shaft 6 and suction and exhaust valves 7A and 7B in such outer shell structures as a crank case 1, head block 2 and rocker cover 3 integrally forming a cylinder barrel.

The above mentioned valve moving device V is formed of a tappet 9 and push rod 10 vertically passing through a tappet chamber 8, a push rod cover 12 covering the outer surface of the push rod 10 and fitted between the tappet chamber 8 and a rocker chamber 11 and a rocker arm 13, rocker arm shaft 14 and rocker arm bracket 15 contained in the rocker chamber. A lead valve type breather device 16 is fitted to the opening end surface of the tapped chamber 8.

The breather device 16 and crank chamber 17 are connected with each other through a ventilating passage P passing through the rocker chamber 11. This ventilating passage P is formed of first and second passages $P_1$ and $P_2$ formed respectively within the peripheral wall of the cylinder and within the inner wall of the head block 2 to connect the crank chamber 17 and the lowest position of the rocker chamber 11 with each other, the rocker chamber 11, the space within the push rod cover 12 and the tappet chamber 8. The above mentioned first and second passages $P_1$ and $P_2$ are formed to be respectively two parallel in the front and rear.

In the drawings, reference numeral 18 denotes a spoon for scraping up oil, 19 denotes a breather pipe for leading a blow-by gas to an air cleaner and 21 denotes an oil returning hole provided through the bottom wall of the tappet chamber 8. Usually, when the diameter of this oil returning hole 21 is made 1 to 2 mm., the diameter of the above mentioned first and second passages $P_1$ and $P_2$ will be set to be about 6.5 mm.

When the ventilating passage P is formed through the rocker chamber 11 as in the above, the misty oil filling the crank chamber 17 will be able to be positively led into the rocker chamber 11 with the movement of the blow-by gas and the rocker arm 13 and rocker arm shaft 14 will be able to be thereby well lubricated. Further, as the gas moving direction is turned within the rocker chamber 11, most of the misty oil will be liquefied within the rocker chamber 11 and will flow down into the crank chamber 17 through the first and second passages $P_1$ and $P_2$. By the way, even within the tappet chamber 8, the mistly oil will be separated by the quick variation of the cross-sectional area of the ventilating passage but the oil liquefied here will flow down into the crank chamber 17 through the oil returning hole 21.

This conventional overhead valve engine is considered to cope with the defects and difficulties of the above mentioned overhead valve engine but has defects that, as the push rod cover 12 is separately formed, the price will be high and the rigidity of the cylinder and cylinder head will be low.

The present invention is suggested with a view to providing a breather device for overhead valve engines wherein the defects of the above mentioned conventional overhead valve engine can be eliminated. The present invention is to provide a breather device for overhead valve engines characterized by being provided with a breather chamber arranged on the side of a cylinder or crank chamber, a push rod chamber formed integrally on the side of said cylinder or crank chamber and a cylinder head and making the periphery of each push rod housed within it a blow-by gas passage connecting the above mentioned crank chamber with a rocker chamber and a blow-by gas discharging passage connecting the above mentioned rocker chamber and breather chamber with each other.

An object of the present invention is to provide a breather device for overhead valve engines wherein, on the basis of the above mentioned formation, the pressure fluctuation within the crank chamber is utilized to utilize the ventilating action of a one-way breather valve, to lubricate the rocker chamber, to need to set no oil pump and to reduce the cost.

Another object of the present invention is to provide a breather device for overhead valve engines wherein, on the basis of the above mentioned formation, the rigidity of the cylinder including the crank case and of the cylinder head is increased.

Further, the present invention is to provide a breather device for overhead valve engines wherein a second breather chamber connected to an air cleaner is provided adjacently to the above mentioned breather chamber and a one-way breather valve allowing only the flow of the gas from said breather chamber to the second breather chamber is provided between said breather chamber and second breather chamber. Further, the present invention is to provide a breather device for overhead valve engines wherein the above mentioned blow-by gas discharging passage is formed integrally with a cylinder head cover opened at one end in the upper part of the above mentioned rocker chamber and at the other end in the above mentioned breather chamber and a breather device for overhead engines wherein a connecting hole connecting the above mentioned breather chamber and crank chamber with each other is provided and a check valve allowing only the flow of the fluid from said breather chamber to the crank chamber is arranged in said connecting hole.

Embodiments of the present invention shall be described in the following with reference to the accompanying drawings in which:

FIG. 1 is a vertically sectioned view;

FIG. 2 is a sectioned view on line II—II in FIG. 1;

FIG. 3 is a vertically sectioned view;

FIG. 4 is a sectioned view on line IV—IV in FIG. 3;

FIG. 5 is a sectioned view on line V—V in FIG. 3;

FIG. 6 is a detailed view of a breather chamber part in FIG. 3;

Figure 1:
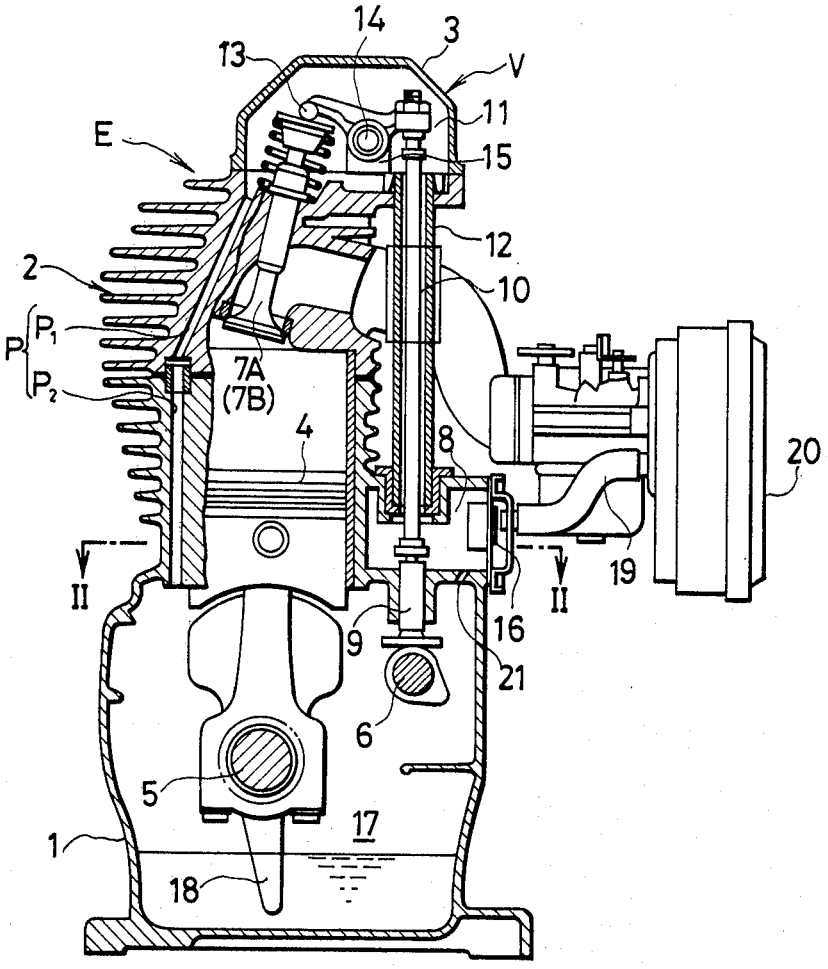
FIGS. 1 and 2 are schematic explanatory views of an example of a coventional overhead valve engine.
Figure 2:
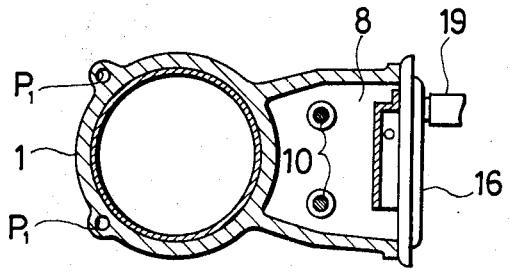
Figure 3:
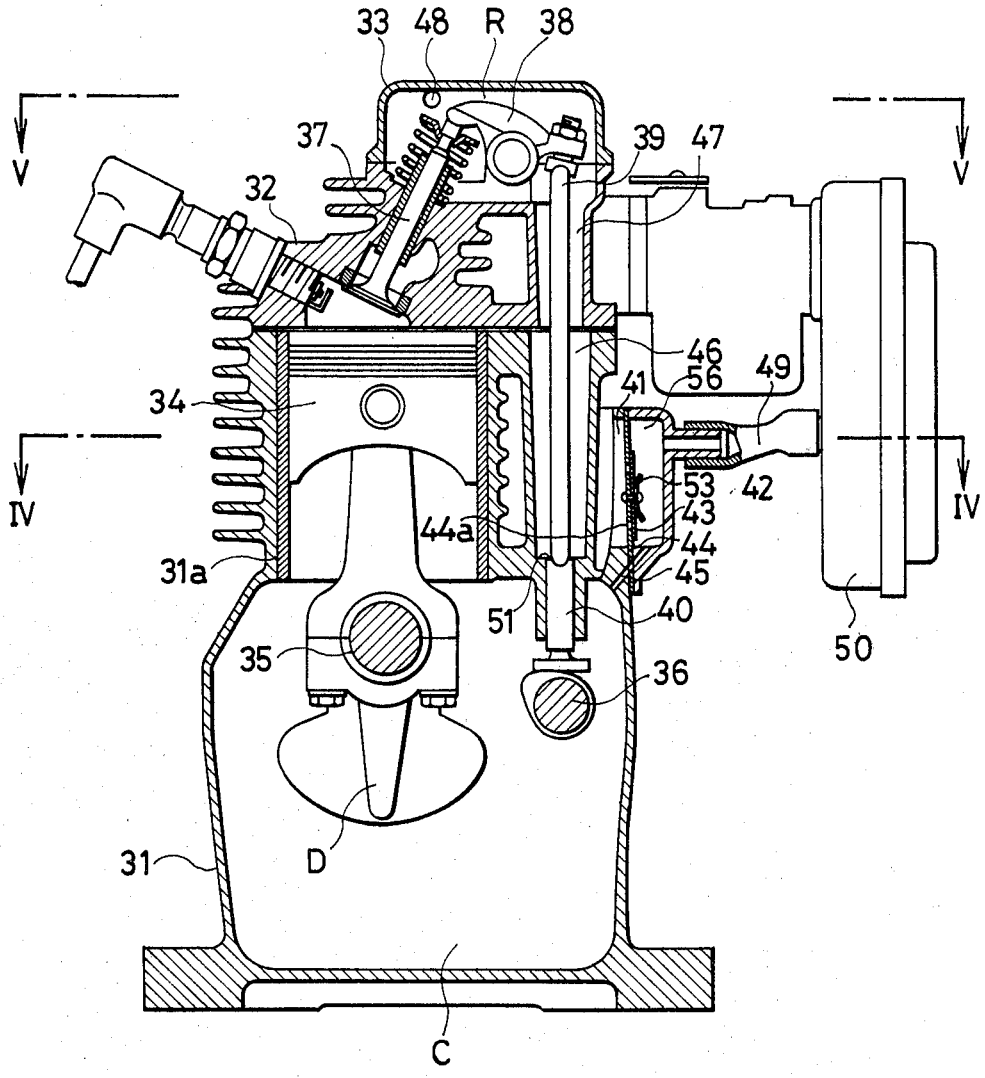
FIGS. 3 to 6 are schematic explanatory views of an embodiment of the present invention.
Figure 4:
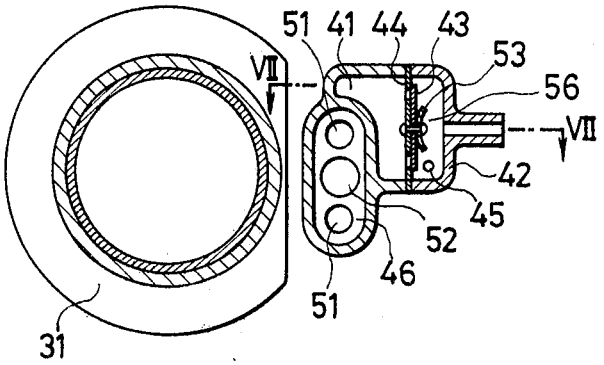
Figure 5:
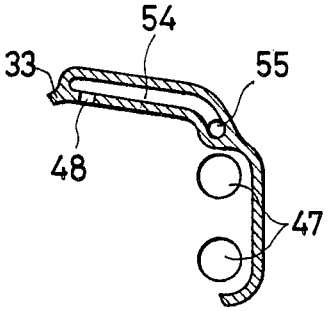
Figure 6:
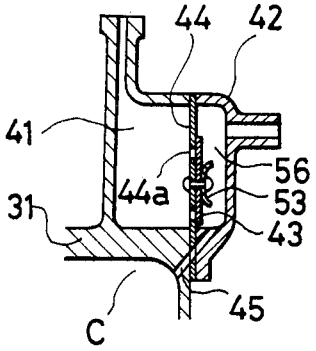

Referring to FIGS. 3 to 6, reference numeral 31 denotes a crank case formed integrally with a cylinder 31*a*, 32 denotes a cylinder head, 33 denotes a cylinder head cover, 34 denotes a piston, 35 denotes a crank shaft, 36 denotes a cam shaft, 37 denotes a valve, 38 denotes a rocker arm, 39 denotes a push rod, 40 denotes a tappet, 41 denotes a breather chamber arranged in a proper place on one side of the upper part of the crank case 31 near the boundary of the crank case 31 with the cylinder 31*a*, 42 denotes a breather chamber lid fitted to the outside of said breather chamber 41 so as to cover said breather chamber 41, 56 denotes a second breather chamber formed through a later mentioned breather plate 44 within the above mentioned breather chamber lid 42, 44 denotes a breather plate provided between said breather chamber 41 and breather chamber lid 42 and having a plurality of blow-by gas ventilating holes 44*a* and a so-called one-way breather valve 43 passing the blow-by gas only to the second breather chamber 56 side from the breather chamber 41 side is fitted to the second breather chamber 56 side of said breather plate 44. By the way, the above mentioned breather chamber 41 and second breather chamber 56 may be arranged in a proper place on one side of the cylinder 31*a*. Reference numeral 45 denotes an oil returning connecting hole connecting the crank chamber C with the space on the breather chamber lid 42 side sectioned by the above mentioned breather plate 44. 46 denotes a first push rod chamber formed in the vertical direction on one side of the cylinder 31*a* formed integrally with the crank case 31. 47 denotes a second push rod chamber formed in the cylinder head 32. Said second push rod chamber 47 has the lower end opening connected with the upper end opening of the above mentioned first push rod chamber 46 and has the upper end opening connected with a rocker chamber R formed as enclosed with the upper end surface of the cylinder head 32 and the cylinder head cover 33. That is to say, the cylinder 31*a* formed integrally with the crank case 31 and a series of push rod chambers formed integrally with the cylinder head 32 are formed of the above mentioned first and second push rod chambers 46 and 47. The above mentioned push rod 39 is to be moved up and down within said push rod chamber by the action of the cam with the rotation of the cam shaft 36 in a predetermined direction through the tappet 40 to open and close the valve 37 through the rocker arm 38. Reference numeral 48 denotes a blow-by gas hole made in the cylinder head cover 33. 49 denotes a pipe connected at one end with the above mentioned second breather chamber 56 and at the other end with an air cleaner 50. 51 denotes a tappet hole of a pair provided in the bottom of the first push rod chamber 46 as shown in FIG. 4. 52 denotes a hole provided in the bottom of the first push rod chamber 46 intermediately between said pair of tappet holes 51 and connecting said first push rod chamber 46 with the crank chamber C. 53 denotes the above mentioned breather valve 43 pressing plate. 54 denotes a blow-by gas passage provided in the cylinder head cover 33 as shown in FIG. 5. 55 denotes a hole made through the cylinder head cover 33, cylinder head 32 and cylinder 31*a* and forming a blow-by gas discharging passage connecting the above mentioned breather chamber 41 and blow-by gas passage 54 with each other.

By the way, symbol D in FIG. 3 denotes an oil scraper agitating the oil within the crank chamber C with the rotation of the crank shaft 35.

An embodiment of the present invention is formed as mentioned above. Now, when the operation of the engine is started, the internal pressure in the crank chamber C will fluctuate to be positive and negative but the average value of said internal pressure will be kept negative by the action of the one-way breather valve 43. The oil within the crank chamber C will be agitated by the oil scraper D so as to be misty, will be led together with the blow-by gas into the rocker chamber R through the connecting hole 52, first push rod chamber 46 and second push rod chamber 47 from the crank chamber C., will here collide with the respective members within said rocker chamber R, will lubricate the rocker arm 38 and valve 37, will then reversely flow through the above mentioned course and will return to the crank chamber C. The blow-by gas will come into the breather chamber 41 through the blow-by gas hole 48, blow-by gas passage 54 and hole 55, will further pass through the one-way breather valve 43 fitted to the breather plate 44 having a plurality of holes and will be discharged into the air cleaner 50 through the second breather chamber 56 and pipe 49. Further, the oil left partly in said space will be separated and will be returned into the crank chamber C through the connecting hole 45.

In the present invention, as the breather chamber 41 and breather chamber lid 42 are arranged on the air cleaner 50 side as illustrated, the pipe 49 can be set to be short and therefore the entire device can be compacted. Further, the first push rod chamber 46 and second push rod chamber 47 forming the push rod chamber are formed integrally respectively with the cylinder 31*a* integral with the crank case 31 and the cylinder head 32, the rigidity of the cylinder including the crank case 31 and of the cylinder head will increase to reduce the noise and increase the strength to more advantage than in the above mentioned overhead valve engine.

Figure 7:
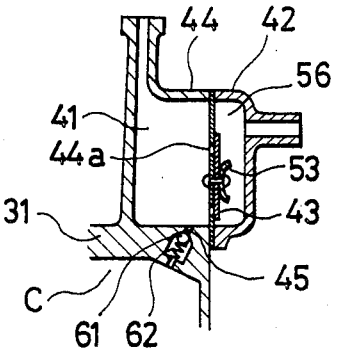
FIGS. 7 and 8 are sectioned views showing another embodiments of a connecting hole for returning oil of the present invention.

FIG. 7 shows a modification of the structure of the connecting hole shown in FIG. 3. That is to say, a check valve formed of a ball 61 and spring 62 is set in the connecting hole 45 for returning the oil.

Figure 8:
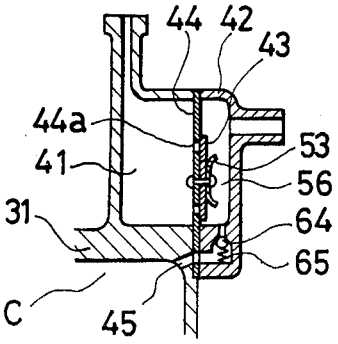

FIG. 8 shows another modification of the structure of the connecting hole shown in FIG. 3. That is to say, a check valve formed of a ball 64 and spring 65 is set in the above mentioned connecting hole 45.

In each of the above mentioned modified structures, the action of discharging oil out of the second breather chamber 56 is better than in FIG. 3. Further, even if the diameter of the above mentioned connecting hole 45 is so small as to be, for example, 4 to 0.5 mm., as the average value of the internal pressure in the crank chamber C is negative and the second breather chamber 56 is under the atmospheric pressure, the oil which has flowed together with the blow-dry gas, has collided with the respective parts and has separated will be smoothly returned to the crank chamber C.

As the present invention has such formation and operation as are mentioned above, according to the invention, there can be obtained such practical effects that (1) the pressure fluctuation within the crank chamber C can be utilized to utilize the ventilating action of the breather valve, to lubricate the rocker chamber R, to need to set no oil pump and to reduce the cost and, (2) as the rigidity of the cylinder 31*a* including the crank case 31 and of the cylinder head 32 will be increased, the defects of the above mentioned overhead valve engine can be eliminated.

We claim:

1. A breather device for overhead valve engines, comprising a breather chamber, a crank chamber and a cylinder having a piston movable in said cylinder and a crank member connected to said piston disposed below said cylinder, a push rod chamber formed on one side of and integrally with said cylinder and said crank chamber, said cylinder having a cylinder head and defining a rocker chamber to one side of said cylinder, a push rod housed within said rocker chamber and said crank chamber, a blow by gas discharging passage formed around the periphery of said push rod and connecting said rocker chamber and said breather chamber, an air cleaner adjacent said breather chamber, a second breather chamber connected to said air cleaner, a one way breather valve allowing only the flow of gas from said breather chamber to said second breather chamber located between said breather chamber and said second breather chamber, said blow by gas discharging passage being opened at one end in the upper part of said rocker chamber and at its other end in said breathing chamber.

2. A breather device for overhead engines according to claim 1, including a connecting hole connecting said breather chamber and said crank chamber.

* * * * *